United States Patent [19]

Takasaki et al.

[11] Patent Number: 4,866,332

[45] Date of Patent: Sep. 12, 1989

[54] TARGET OF IMAGE PICKUP TUBE

[75] Inventors: Yukio Takasaki, Kawasaki; Tatsuo Makishima, Mitaka; Kazutaka Tsuji, Hachioji; Tadaaki Hirai, Koganei; Eisuke Inoue; Yasuhiko Nonaka, both of Mobara; Naohiro Goto, Machida; Masanao Yamamoto, Mobara; Keiichi Shidara, Tama; Kenkichi Tanioka, Tokyo; Takashi Yamashita, Sagamihara; Tatsuro Kawamura, Tama; Eikyuu Hiruma, Komae; Shirou Suzuki, Yokosuka; Masaaki Aiba, Tokyo, all of Japan

[73] Assignees: Hitachi, Ltd.; Nippon Hoso Kyokai, both of Tokyo, Japan

[21] Appl. No.: 16,403

[22] Filed: Feb. 19, 1987

[30] Foreign Application Priority Data

Mar. 26, 1986 [JP] Japan ..... 61-65760

[51] Int. Cl.[4] ..... H01J 29/45

[52] U.S. Cl. ..... 313/386; 313/388

[58] Field of Search ..... 313/385, 386, 388; 252/301.4 H, 500

[56] References Cited

U.S. PATENT DOCUMENTS

| | | | |
|---|---|---|---|
| 3,890,525 | 6/1975 | Hirai et al. | 313/386 |
| 4,040,985 | 8/1977 | Shidara et al. | 252/501 |
| 4,307,319 | 12/1981 | Terao et al. | 313/386 |
| 4,330,733 | 5/1982 | Shidara et al. | 313/386 |
| 4,463,279 | 7/1984 | Shidara et al. | 313/386 |

*Primary Examiner*—Kenneth Wieder

*Attorney, Agent, or Firm*—Antonelli, Terry & Wands

[57] ABSTRACT

A target of an image pickup tube, having a transparent substrate, a transparent conductive film, a p-type photoconductive film made mainly from amorphous Se, and an n-type conductive film capable of forming a rectifying contact at the interface with the p-type photoconductive film, using the rectifying contact as a reverse bias, characterized in that the p-type photoconductive film containing at least a region having more than 35%, and to 60% by weight of Te in the film thickness direction, and at least a region containing 0.005 to 5% by weight of at least a material capable of forming shallow levels in the amorphous Se in the film thickness direction, has good after-image characteristics even if operated at a high temperature.

22 Claims, 4 Drawing Sheets

TARGET OF IMAGE PICKUP TUBE

BACKGROUND OF THE INVENTION

This invention relates to a target of an image pickup tube for television, and more particularly to a target of image pickup tube capable of reducing the after-image effect when operated at a high temperature.

Amorphous selenium (Se) has a photoconductivity and generally also has a p-type conductivity, forming a rectifying contact with an n-type conductive material. Thus, a photodiode type target of an image pickup tube can be made from the amorphous Se on the basis of these characteristics. However, amorphous Se is insensitive to the long wavelength of light and it has been a practice to add tellurium (Te) to a region of a Se layer to improve the sensitivity to the long wavelength of light (U.S. Pat. No. 3,890,525 and U.S. Pat. No. 4,040,985).

Furthermore, it has been also proposed to add a specific fluoride to a region of the p-type photoconductive layer to improve the responsiveness when an incident light of high intensity is cut off (U.S. Pat. No. 4,330,733).

FIG. 1 shows one example of a target structure according to the prior art, wherein numeral 1 is a transparent substrate, 2 a transparent conductive film, 3 a p-type photoconductive layer made from Se-As-Te, 4 a p-type photoconductive layer made from Se-As, and 5 a landing layer of the scanning electron beam made from porous $Sb_2S_3$. Te is a component for enhancing the sensitivity to red light, as described above, and arsenic (As) is a component for increasing the viscosity of an amorphous film composed mainly of Se and enhancing the thermal stability. With this structure the target can act as a photodiode type to block the injection of holes and scanning electrons and thus can have such imaging characteristics as less dark current and less lag.

The target of an image pickup tube according to the prior art can have good imaging characteristics under the normal operating conditions, but still has such a drawback as an increased after-image when operated at a high temperature, because no thorough consideration is given to a higher temperature during the operation of image pickup tubes.

SUMMARY OF THE INVENTION

An object of the present invention is to provide a target of an image pickup tube having an improved photoconductive film made mainly from Se and capable of reducing the after-image of the target even if operated at a high temperature.

The said object of the present invention can be attained by a photoconductive target of the image pickup tube, which comprises an n-type conductive film and a p-type photoconductive film made mainly from amorphous Se and including a region containing Te in the film thickness direction to increase the sensitivity to red light, characterized in that the p-type photoconductive film has a region containing Te at a high concentration in the film thickness direction and a region containing a material capable of forming shallow levels in the amorphous Se in the film thickness direction.

In a target of an image pickup tube comprising at least a p-type photoconductive film made mainly from amorphous Se and an n-type conductive film that forms a rectifying contact at the interface with the p-type photoconductive film, using the rectifying contact as a backward bias, the after-image resulting when operated at a high temperature can be reduced in the present invention by using as the p-type photoconductive film a film having a region containing over 35%, and to 60%, by weight of Te in the film thickness direction (which will be hereinafter referred to as region of high Te concentration) and a region containing 0.005 to 5% by weight of at least one material capable of forming shallow levels in the amorphous Se in the film thickness direction.

FIG. 2 shows, as one embodiment of the present invention, a profile of component distribution in the part corresponding to the layer 3 of FIG. 1 showing the structure in principle of a target of image pickup tube according to the prior art, where the ratio of components is or will be expressed by weight.

In the embodiment of FIG. 2, no Te exists at the position of zero film thickness which corresponds to the interface with the transparent conductive film (region a) in the film thickness direction, and the concentration of Te steeply rises at the position corresponding to 500 Å and Te is uniformly distributed at the concentration of 45% therefrom over a distance of 600 Å in the film thickness direction (region b). In the region b, LiF is uniformly distributed at the concentration of 0.8% from the contact point between the regions a and b over a distance of 300 Å in the film thickness direction. As is uniformly distributed at the concentration of 6% throughout the region a and at the concentration of 3% throughout the region b in the film thickness direction. The structure of Te and As distributions is the same as that of FIG. 1 in principle, but the after-image when operated at a high temperature can be reduced without deteriorating the so far available characteristics of the p-type photoconductive film by providing a region of high Te concentration and a region containing LiF capable of forming shallow levels in a p-type photoconductive film in the film thickness direction. In FIG. 2, the region c is an auxiliary sensitizing region made from Se and As, where the concentration of As is 30% at the position in contact between the regions b and c, and is continuously decreased therefrom to 3% over a distance of 300 Å in the film thickness direction.

In the embodiment of FIG. 2, Te is uniformly distributed in the film thickness direction, but it is not always necessary that the distribution be uniform. That is, the distribution can have a variation of concentration. For example, the region b can be made from one region containing Te at the concentration of 30% from the position in contact between the regions a and b over a distance of 150 Å in the film thickness direction and another region containing Te at the concentration of 50% from the 30% Te region over a distance of 200 Å in the film thickness direction, or from one region containing Te at the concentration of 40% from the position in contact between the regions a and b over a distance of 150 Å in the film thickness direction and another region containing Te at the concentration of 45% from the 40% Te region over a distance of 200 Å in the film thickness direction.

In this embodiment, LiF is used as a material capable of forming shallow levels in the amorphous Se, but the material is not limited to LiF, and can be at least one of fluorides such as LiF, NaF, $MgF_2$, $CaF_2$, $AlF_3$, $CrF_3$, $MnF_2$, $CoF_2$, $PbF_2$, $BaF_2$, $CeF_3$ and TlF, alkali and alkaline earth metals such as Li, Na, K, Cs, Ca, Mg, Ba and Sr, and Tl.

It is essential that the p-type photoconductive film has a region containing Te at a concentration of more than 35%, and to 60%, preferably more than 35%, and to 50%, in the film thickness direction, and a region containing a material capable of forming shallow levels in the amorphous Se at a concentration of 0.005 to 5% in the film thickness direction. It is preferable that the region containing a material capable of forming shallow levels in the amorphous Se is located within the region containing Te or nearer the light incident side than the region containing Te.

FIG. 3 shows the effect of the present invention when the targets of image pickup tubes having the photoconductive film shown in FIG. 2 were operated at varied temperatures, i.e. 40° C., 45° C. and 50° C., while changing the concentration of Te in the targets.

In FIG. 3 a group of curves 101 shows dependence of the after-image decay time upon the concentration of Te when the targets of image pickup tubes having a photoconductive film according to the present invention are operated at various high temperatures, and a group of curves 102 shows dependence of the after-image decay time upon the concentration of Te when targets of image pickup tubes having a photoconductive film according to the present invention are operated at various high temperatures.

As is obvious from FIG. 3, it is necessary that the concentration of Te is in a range of more than 35%, and to 60%, to obtain an acceptable after-image effect in a high temperature range of 40° to 50° C. When the after-image decay time in the high temperature range is also taken into account, the concentration of Te is preferable in a range of more than 35%, and to 50%.

FIG. 4 shows results of detailed studies on changes in the characteristics having the concentration of Te and that of LiF in the target shown in FIG. 2. In the region (A) with a lower concentration of LiF, the dark current is increased when the target of an image pickup tube is operated in the high temperature range, and the target fails to act as a blocking type target of the image pickup tube. In the region (B) with a higher concentration of LiF, the after-image is undesirably increased after a high light incidence exceeding the normal light level of incident light, when the target is operated in the high temperature range. In the regions (C) and (D), the after-image is larger when targents of image pickup tubes having such a photoconductive film are operated in the high temperature range, as described before. As is obvious from these results, it is necessary that the material capable of forming shallow levels has a concentration of 0.005 to 5% to attain the effect of the present invention.

There have been also already proposed a process for reducing the dark current by providing an auxiliary layer for the rectifying contact, made, for example, from oxides that show n-type conduction, such as $CeO_2$, etc. between the n-type conductive film and the p-type photoconductive film composed mainly from amorphous Se (e.g. U.S. Pat. No. 4,307,319) and a process for making a photoconductive film for the target of image pickup tube, made mainly from amorphous Se, by deposition with a good reproducibility by heating and maintaining the substrate at an appropriate temperature below 60° C. during the deposition (Japanese Patent Application No. 60-114,090). The object of the present invention can be effectively attained even if the present invention is combined with these processes.

Furthermore, the object of the present invention can be also attained by combining the present invention with a process for decreasing the after-image effect by strong light or the variation of sensitivity right after the actuation of image pickup tube by adding $GaF_3$, $MoO_3$, $In_2O_3$, etc. to at least a region of the auxiliary sensitizing layer (U.S. Pat. No. 4,463,279, U.S. patent application Ser. No. 736149 or Japanese Patent Application Kokai (Laid-open) No. 60-245283) without deteriorating the desired effects of the latter process.

DESCRIPTION OF PREFERRED EMBODIMENTS

Figure 1:
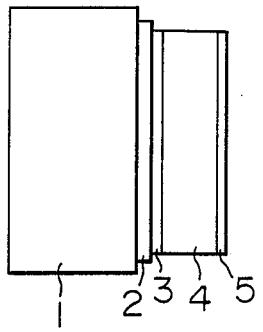
FIG. 1 PRIOR ART
FIG. 1 is a cross-sectional view of a target of image pickup tube according to the prior art.
Figure 2:
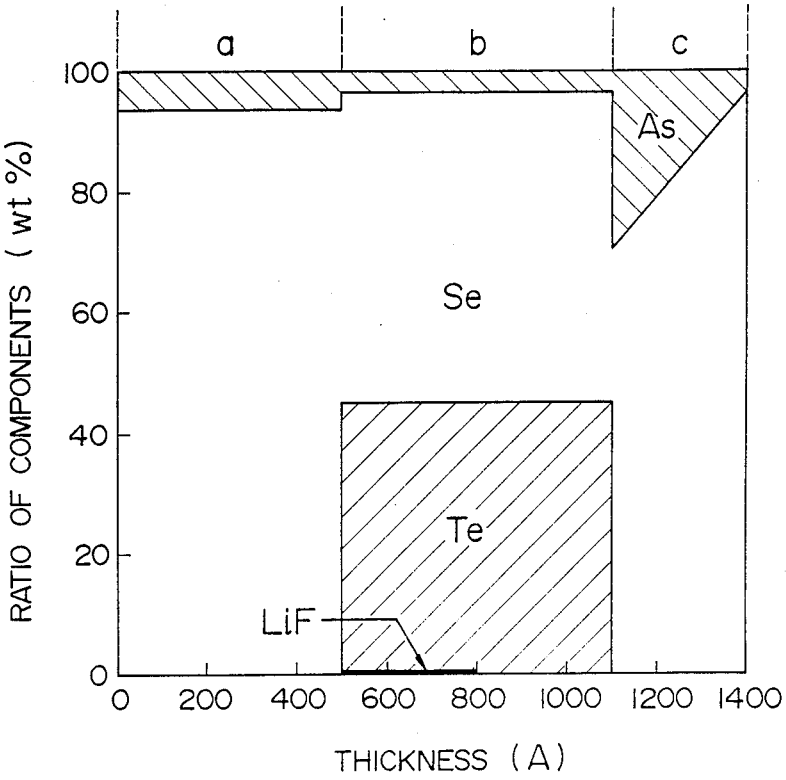
FIG. 2 is a profile of distribution of component materials that constitute the essential part of a target of image pickup tube according to the present invention.
Figure 3:
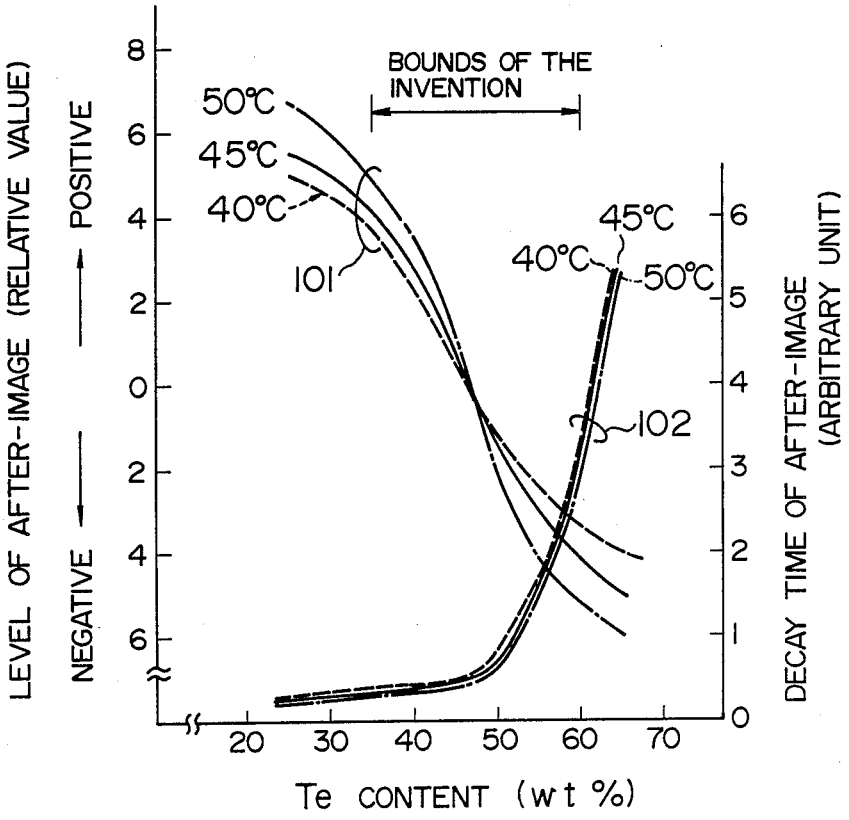
FIG. 3 is a diagram showing the dependence of the after-image level and the after-image decay time upon the concentration of Te in a photoconductive film of the target of an image pickup tube when operated at a high temperature.
Figure 4:
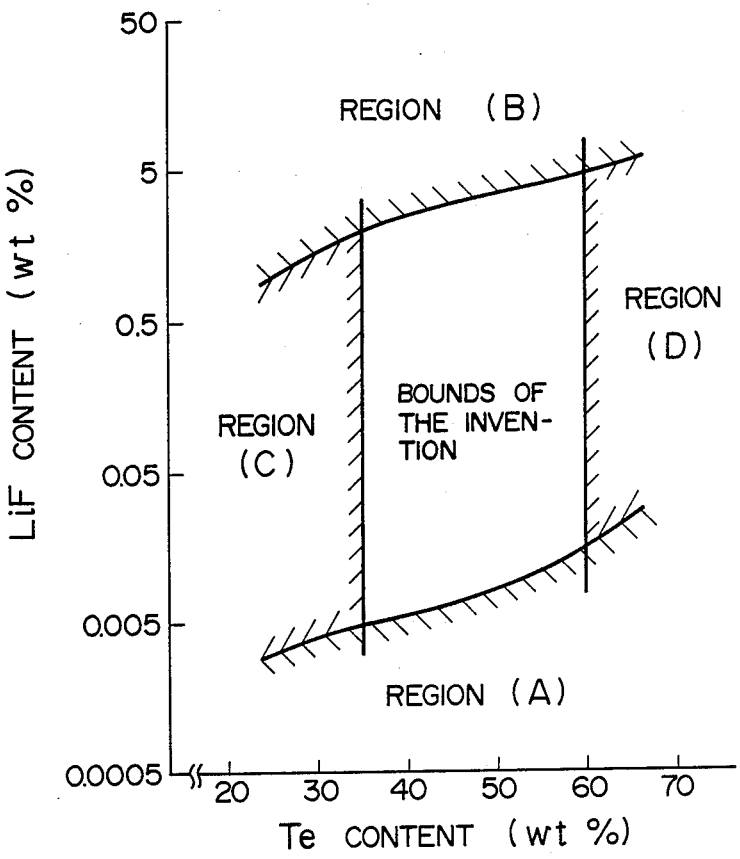
FIG. 4 is a diagram defining the present invention by the degree of concentration of Te and that of LiF in a photoconductive film of the target of an image pickup tube.

The present invention will be described in detail below, referring to Examples.

EXAMPLE 1

A transparent conductive film made mainly from tin oxide is formed on a glass substrate, and then Se, $As_2Se_3$ and LiF are desposited thereon to a thickness of 300 Å from the respective deposition sources as a first layer, where As and LiF are uniformly distributed in the film thickness direction at the As concentration of 10% and at the LiF concentration of 6,000 ppm.

Se, $As_2Se_3$, Te, and LiF are desposited onto the first layer to a thickness of 600 to 900 Å from the respective deposition sources as a second layer, where Te, As and LiF are uniformly distributed in the film thickness direction at the Te concentration of 40%, the As concentration of 2%, and the LiF concentration of 40,000 ppm. Then, a third layer is deposited onto the second layer. As a first half region of the third layer, Se, $As_2Se_3$ and $In_2O_3$ are deposited onto the second layer to a thickness of 60 Å from the respective deposition sources, where As and $In_2O_3$ are uniformly distributed to the film thickness direction at the As concentration of 30% and the $In_2O_3$ concentration of 500 ppm. As a second half region of the third layer, Se, $As_2Se_3$ and $In_2O_3$ are deposited onto the first half region to a thickness of 50 Å, where As and $In_2O_3$ are uniformly distributed in the film thickness direction at the As concentration of 3% and the $In_2O_3$ concentration of 500 ppm.

The former half region and the latter half region constitute an auxiliary sensitizing layer together. Then, a fourth layer made from Se and As is deposited onto the third layer to make the total film thickness 6 μm, where As is uniformly distributed at the As concentration of 3% in the film thickness direction throughout the fourth layer. Deposition of the first layer up to the fourth layer is carried out under vacuum of $2\times10^{-6}$ Torr.

A layer of $Sb_2S_3$ is deposited onto the fourth layer to a thickness of 500 Å in the atmosphere of argon under $3\times10^{-1}$ Torr.

EXAMPLE 2

A transparent conductive film made mainly from tin oxide is formed on a glass substrate, and $GeO_2$ and $CeO_2$ are deposited to a thickness of 200 Å each in this order under vacuum of $2\times10^{-6}$ Torr as auxiliary layers for rectifying contact. Se and $As_2Se_3$ are then deposited thereon to a thickness of 200 to 500 Å from respective deposition sources as a first layer, where As is uniformly distributed at a concentration of 10% in the film thickness direction. As a first half region of a second layer, Se, $As_2Se_3$, Te and LiF are deposited to a thickness of 150 Å onto the first layer from the respective deposition sources, where As, Te and LiF are uniformly distributed at a As concentration of 2%, a Te concentration of 30% a the LiF concentration of 8,000 ppm in the film thickness direction. Then, as a second half region of the second layer, Se, $As_2Se_3$ and Te are deposited to a thickness of 150 Å onto the first half region from the respective deposition source, where As and Te are uniformly distributed at the As concentration of 2% and the Te concentration of 60%. A third layer made from Se and As is deposited to a thickness of 300 Å onto the second layer as an auxiliary sensitizing layer, where Se and $As_2Se_3$ are deposited at the same time from the respective deposition sources. By controlling the current to the respective deposition sources, the As concentration of the third layer is adjusted initially from 33% at the beginning of the third layer finally to 2% at the end of the third layer while continuously decreasing the As concentration as the deposition proceeds.

Then, Se and $As_2Se_3$ are deposited onto. the third layer from the respective deposition source at the same time as a fourth layer to make the total film thickness 4 μm, where an As is uniformly distributed at the As concentration of 2% in the film thickness direction throughout the fourth layer. Deposition of the first layer up to the fourth layer is carried out under vacuum of $2\times10^{-6}$ Torr.

$Sb_2S_3$ is deposited to a thickness of 700 Å onto the fourth layer in the atmosphere of argon under $2\times10^{-1}$ Torr as an auxiliary layer for beam landing.

EXAMPLE 3

A transparent conductive film made mainly from tin oxide is formed on a glass substrate, and then $CeO_2$ is deposited thereon to a thickness of 300 Å under vacuum of $2\times10^{-6}$ Torr as an auxiliary layer for rectifying contact. Se, $As_2Se_3$ and LiF are deposited thereon to a thickness of 200 Å from the respective deposition sources as a first layer, where As and LiF are uniformly distributed at an As concentration of 10% and a LiF concentration of 8000 ppm in the film thickness direction.

Then, Se, $As_2Se_3$ and Te are deposited to a thickness of 500 to 750 Å onto the first layer from the respective deposition sources as a second layer, where Te and As are uniformly distributed at the Te concentration of 36% and the As concentration of 2% in the film thickness direction. A third layer is deposited onto the second layer. As a first half region of the third layer, Se and $As_2Se_3$ are deposited onto the second layer to a thickness of 60 Å from the respective deposition source, where As is uniformly distributed at the As concentration of 25% in the film thickness direction. Then, as a second half region of the third layer, Se, $As_2Se_3$ and $GaF_3$ are deposited thereon to a thickness of 150 Å from the respective deposition sources, where As and $GaF_3$ are uniformly distributed at the As concentration of 25% and the $GaF_3$ concentration of 2,500 ppm in the film thickness direction. The first half region and the second half region of the third layer constitute an auxiliary sensitizing layer together. Then, a fourth layer made from Se and As is deposited thereon to make the entire film thickness 5 μm, where As is uniformly distributed at the As concentration of 2% in the film thickness direction throughout the fourth layer. Deposition of the first layer up to the fourth layer is carried out under vacuum of $2\times10^{-6}$ Torr. $Sb_2S_3$ is deposited onto the fourth layer to a thickness of 500 Å in the atmosphere of argon of $3\times10^{-1}$ Torr.

EXAMPLE 4

A transparent conductive film made mainly from indium oxide is formed on a glass substrate, and then $CeO_2$ is deposited thereon to a thickness of 200 Å under vacuum of $2\times10^{-6}$ Torr as an auxiliary layer for rectifying contact. As a first half region of a first layer, Se, $As_2Se_3$ and $CaF_2$ are deposited thereon to a thickness of 150 Å from the respective deposition sources, where As and $CaF_2$ are uniformly distributed at a As concentration of 6% and the $CaF_2$ concentration of 3,000 ppm in the film thickness direction. Then, as a second half region of the first layer, Se, $As_2Se_3$ and $CaF_2$ are deposited onto the first half region to a thickness of 150 Å from the respective deposition sources, where As and $CaF_2$ are uniformly distributed at an As concentration of 15% and a $CaF_2$ concentration of 9,000 ppm in the film thickness direction. The first and second regions together half constitute the first layer.

As a first half region of a second layer, Se, $As_2Se_3$, Te and $CaF_2$ are deposited onto the first layer to a thickness of 100 to 150 Å from the respective deposition sources, where Te, As and $CaF_2$ are uniformly distributed at a Te concentration of 45 to 50%, an As concentration of 2%, and a $CaF_2$ concentration of 6,000 ppm in the film thickness direction. As a second half region of the second layer, Se, $As_2Se_3$ and Te are deposited onto the first half region to a thickness of 100 to 150 Å from the respective deposition sources, where Te and As are uniformly distributed at a Te concentration of 45 to 50% and an As concentration of 2% in the film thickness direction.

Then, a third layer is deposited on the second layer. As a first half region of the third layer, Se, $As_2Se_3$ and $In_2O_3$ are deposited onto the second layer to a thickness of 50 Å from the respective deposition sources, where As and $In_2O_3$ are uniformly distributed at an As concentration of 25% and an $In_2O_3$ concentration of 500 ppm in the film thickness direction. Furthermore, as a second half region of the third layer, Se and $As_2Se_3$ are deposited onto the first half region to a thickness of 300 Å from the respective deposition sources, where by controlling the current to the respective deposition sources the As concentration is adjusted initially from 25% at the beginning of the region finally to 3% at the end of the region while continuously decreasing the As concentration as the deposition proceeds. The first half region and the second half region of the third layer constitute an auxiliary sensitizing layer.

Then, a fourth layer made from Se and As is deposited onto the third layer to make the entire film thickness 4 μm, where As is uniformly distributed at the As concentration of 3% in the film thickness direction throughout the fourth layer.

Deposition of the first layer up to the fourth layer is carried out under vacuum of $2\times10^{-6}$ Torr.

$Sb_2S_3$ is deposited onto the fourth layer to a thickness of 1,000 Å in the atmosphere of argon under $5\times10^{-1}$ Torr.

EXAMPLE 5

A transparent conductive film made mainly from tin oxide is formed on a glass substrate, and then $GeO_2$ and $CeO_2$ are deposited thereon to a thickness of 150 Å and a thickness of 200 Å, respectively, in this order under vacuum of $2\times10^{-6}$ Torr as auxiliary layers for rectifying contact. Then, as a first half region of a first layer, Se, $As_2Se_3$ and LiF are deposited thereon to a thickness of 200 Å from the respective deposition sources, where As and LiF are uniformly distributed at a As concentration of 5% and a LiF concentration of 2,000 ppm in the film thickness direction. The substrate temperature is kept at 30° C. during the deposition of the former half region of the first layer. Then, as a second half region of the first layer, Se, $As_2Se_3$ and LiF are deposited on the first half region to a thickness of 100 Å from the respective deposition sources, where As and LiF are uniformly distributed at an As concentration of 18% and a LiF concentration of 8,000 ppm. The substrate temperature is kept at 35° C. during the deposition of the latter half region. The former half region and the latter half region constitute the first layer together.

As a former half region of a second layer, Se, $As_2Se_3$, Te and LiF are deposited onto the first layer to a thickness of 150 Å from the respective deposition sources, where As, Te and LiF are uniformly distributed at an As concentration of 2%, a Te concentration of 45%, a the LiF concentration of 6,000 ppm in the film thickness direction. Then, Se, $As_2Se_3$, Te and LiF are deposited onto the first half region to a thickness of 150 to 200 Å from the respective deposition sources to form the second half region of the second layer, where As, Te and LiF are uniformly distributed at the As concentration of 2%, the Te concentration of 50% and the LiF concentration of 6,000 ppm. The substrate temperature is kept at 40° C. during the deposition of the second layer.

A third layer made from Se and As is deposited onto the second layer to a thickness of 350 Å as an auxiliary sensitizing layer, where Se and $As_2Se_3$ are deposited from the respective deposition sources at the same time, and by controlling the current to the respectove deposition sources the As concentration is adjusted initially from 30% at the beginning of the third layer finally to 2% at the end of the third layer, while continuously decreasing the concentration as the deposition proceeds. As a fourth layer, Se and $As_2Se_3$ are deposited onto the third layer from the respective deposition sources at the same time to make the entire film thickness 6 μm, where As is uniformly distributed at the As concentration of 2% throughout the fourth layer. The substrate temperature is kept at 43° C. during the deposition of the third and fourth layers. Deposition of the first layer up to the fourth layer is carried out under vacuum of $2\times10^{-6}$ Torr.

$Sb_2S_3$ is deposited onto the fourth layer to a thickness of 700 Å in the atmosphere of argon under $3\times10^{-1}$ Torr as an auxiliary layer for beam landing.

EXAMPLE 6

A transparent conductive film made mainly from tin oxide is formed on a glass substrate, and then $CeO_2$ is deposited thereon to a thickness of 200 Å in vacuum of $2\times10^{-6}$ Torr as an auxiliary layer for rectifying contact. Then, Se and $As_2Se_3$ are deposited thereon to a thickness of 300 Å from the respective deposition sources as a first layer, where As is uniformly distributed at the As concentration of 10% in the film thickness direction. As a second layer, Se, $As_2Se_3$, Te and LiF are deposited onto the first layer to a thickness of 300 Å from the respective deposition sources, where As, Te and LiF are uniformly distributed at the As concentration of 2%, the Te concentration of 60% and the LiF concentration of 5% in the film thickness direction. Then, a third layer made from Se and As is deposited onto the second layer to a thickness of 300 Å as an auxiliary sensitizing layer, where by controlling the current to the respective deposition sources the As concentration is continuously decreased from 30% to 2% in the film thickness direction in a constant rate. Then, a fourth layer made from Se and As is deposited onto the third layer to make the entire film thickness 4 μm, where As is uniformly distributed at the As concentration of 2% in the film thickness direction throughout the fourth layer.

Deposition of the first layer up to the fourth layer is carried out under vacuum of $2\times10^{-6}$ Torr.

$Sb_2S_3$ is deposited onto the fourth layer to a thickness of 1,000 Å in the atmosphere of argon under $5\times10^{-1}$ Torr.

EXAMPLE 7

A transparent conductive film made mainly from indium oxide is formed on a glass substrate, and Se, $As_2Se_3$ and LiF are deposited thereon to a thickness of 300 Å from the respective deposition sources as a first layer, where As and LiF are uniformly distributed at an As concentration of 6% and a LiF concentration of 50 ppm in the film thickness direction. Then, as a first half region of a second layer, Se, $As_2Se_3$, Te and LiF are deposited onto the first layer to a thickness of 150 Å from the respective deposition sources, where As, Te and LiF are uniformly distributed at an As concentration of 2%, a Te concentration of 30% and a LiF concentration of 50 ppm in the film thickness direction. Then, Se, $As_2Se_3$ and Te are deposited onto the first half region to a thickness of 400 Å from the respective deposition sources to form a second half region of the second layer, where As and Te are uniformly distributed at the As concentration of 2% and the Te concentration of 45% in the film thickness direction.

A third layer made from Se and As is deposited onto the second layer to a thickness of 300 Å as an auxiliary sensitizing layer, where by controlling the current to the respective deposition sources the As concentration is continuously decreased from 25% to 2% in the film thickness direction throughout the third layer. As a fourth layer, Se and $As_2Se_3$ are deposited onto the third layer from the respective deposition sources at the same time to make the entire film thickness 6 μm, where As is uniformly distributed at the As concentration of 2% in the film thickness direction throughout the fourth layer.

Deposition of the first layer up to the fourth layer is carried out under vacuum of $2\times10^{-6}$ Torr.

$Sb_2S_3$ is deposited onto the fourth layer to a thickness of 700 Å in the atmosphere of argon under $5\times10^{-2}$ Torr.

Figure 5:
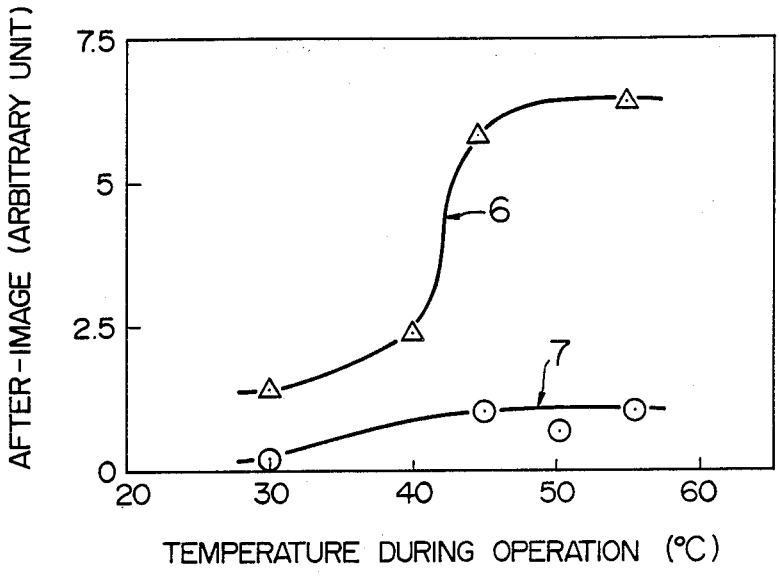
FIG. 5 is a diagram comparing the after-image characteristics of a target of an image pickup tube according to the prior art with that according to the present invention.

FIG. 5 shows comparison of the after-image characteristics of a target of image pickup tube having the photoconductive film according to the prior art with that according to the present invention, where the after-image after a black-and-white pattern has been picked up for 10 minutes is given, and curve 6 is directed to the after-image characteristics of the target of image pickup tube having a photoconductive film (Te concentration: 30%) according to the prior art, whereas curve 7 is directed to that of the target of image pickup tube having a photoconductive film (Te concentration: 45%) according to the present invention. As is obvious from FIG. 5, the target of image pickup tube having the photoconductive film according to the prior art has a considerably increased after-image when operated at a high temperature, whereas that of the present invention has only a slight increase in the after-image when operated at the high temperature.

A target of image pickup tube having a photoconductive film according to the present invention has good after-image characteristics, even if operated at a high temperature, without deteriorating the so far available characteristics.

What is claimed is:

1. A target of an image pickup tube, which comprises a transparent substrate, a transparent conductive film, a p-type photoconductive film comprising Se, and an n-type conductive film capable of forming a rectifying contact at the interface with the p-type photoconductive film, using the rectifying contact as a reverse bias, each of the conductive film, the p-type photoconductive film and the n-type conductive film being provided one on the other, the p-type photoconductive film extending in a thickness direction, the p-type photoconductive film including at least a region containing more than 35%, and to 60%, by weight of Te, in the film thickness direction, and a region containing 0.005 to 5% by weight of a material capable of forming shallow levels in the amorphous Se, in the film thickness direction, whereby a target is provided having improved after-image characteristics at temperatures of at least 40° C., as compared to after-image characteristics of targets containing lesser amounts of Te.

2. A target of an image pickup tube according to claim 1, wherein the material capable of forming shallow levels in the amorphous Se is at least one member selected from the group consisting of LiF, NaF, $MgF_2$, $CaF_2$, $AlF_3$, $CrF_3$, $MnF_2$, $CoF_2$, $PbF_2$, $BaF_2$, $CeF_3$, TlF, Li, Na, K, Cs, Ca, Mg, Ba, Sr and Tl.

3. A target of an image pickup tube according to claim 1 or 2, wherein the p-type photoconductive film contains at least a region containing more than 35%, and to 50%, by weight of Te in the film thickness direction.

4. A target of an image pickup tube according to claim 1, wherein said p-type photoconductive film includes an auxiliary sensitizing region.

5. A target of an image pickup tube according to claim 4, wherein said auxiliary sensitizing region includes at least one substance selected from the group consisting of $GaF_3$, $MoO_3$ and $In_2O_3$.

6. A target of an image pickup tube according to claim 1, wherein the region containing a material capable of forming shallow levels in the amorphous Se is provided within the region containing more than 35%, and to 60%, by weight of Te.

7. A target of an image pickup tube according to claim 1, wherein the region containing a material capable of forming shallow levels in the amorphous Se is provided closer to the transparent substrate than is the region containing more than 35%, and to 60%, by weight of Te.

8. A target of an image pickup tube according to claim 1, further comprising a layer formed of an oxide having n-type conductivity positioned between the n-type conductive film and p-type photoconductive film.

9. A target of an image pickup tube according to claim 1, wherein the p-type photoconductive film includes (1) a first layer including As, Se and the material capable of forming shallow levels in the amorphous Se; (2) a second layer consisting essentially of As, Se, the material capable of forming shallow levels in the amorphous Se, and Te, the second layer containing more than 35%, and up to 60%, by weight of Te; (3) an auxiliary sensitizing layer; and (4) a further layer, of Se and As.

10. A target of an image pickup tube according to claim 9, wherein said auxiliary sensitizing layer includes a first sub-layer of Se, As and $In_2O_3$, with As and $In_2O_3$ being uniformly distributed in the film thickness direction at an As concentration of 30% and an $In_2O_3$ concentration of 500 ppm; and a second sub-layer of Se, As and $In_2O_3$, with As and $In_2O_3$ being uniformly distributed in the film thickness direction at an As concentration of 3% and an $In_2O_3$ concentration of 500 ppm.

11. A target of an image pickup tube according to claim 1, further comprising at least one auxiliary layer for rectifying contact, provided between the transparent conductive film and the p-type photoconductive film; and wherein the p-type photoconductive film includes (1) a first layer formed by deposition of Se and $As_2Se_3$, (2) a second layer comprising a first sub-layer including As, Se, Te and the material capable of forming shallow levels in the amorphous Se, and a second sub-layer consisting essentially of As, Se and more than 35%, and to 60%, by weight of Te, (3) an auxiliary sensitizing layer, of Se and As, having a decreasing As concentration in the auxiliary sensitizing layer, in the thickness direction, and (4) a layer formed by deposition of Se and $As_2Se_3$.

12. A target of an image pickup tube according to claim 1, further comprising at least one auxiliary layer for rectifying contact, provided between the transparent conductive film and the p-type photoconductive film; and wherein the p-type photoconductive film comprises (1) a first layer including As, Se and the material capable of forming shallow levels in the amorphous Se, (2) a second layer consisting essentially of As, Se and Te, the second layer containing more than 35%, and to 60%, by weight of Te, (3) an auxiliary sensitizing layer including a first sub-layer formed by depositing Se and $As_2Se_3$, and a second sub-layer formed by depositing Se, $As_2Se_3$ and $GaF_3$, and (4) a fourth layer made from Se and As.

13. A target of an image pickup tube according to claim 1, further comprising at least one auxiliary layer for rectifying contact, provided between the transparent conductive film and the p-type photoconductive film, and wherein the p-type photoconductive film includes (1) a first layer comprising first and second sub-layers, each sub-layer including As, Se and the material capable of forming shallow levels in the amorphous Se, (2) a second layer comprising first and second sub-layers, the first sub-layer of said second layer including As, Se, Te and the material capable of forming shallow levels in the amorphous Se, the first sub-layer containing more than 35%, and up to 60%, by weight of Te, and the second sub-layer consisting essentially of As, Se and Te, the second sub-layer containing more than 35%, and up to 60%, by weight of Te, (3) an auxiliary sensitizing layer comprising first and second sub-layers, the first sub-layer being formed by depositing Se, $As_2Se_3$ and $In_2O_3$, the second sub-layer being formed by depositing Se and $As_2Se_3$, the As concentration in the second sub-layer of the auxiliary sensitizing layer decreasing in the thickness direction, and (4) a fourth layer formed by depositing Se and As.

14. A target of an image pickup tube according to claim 1, further comprising at least one auxiliary layer for rectifying contact, provided between the transparent conductive film and the p-type photoconductive film, and wherein the p-type photoconductive film comprises (1) a first layer comprising first and second sub-layers, each of the first and second sub-layers including As, Se and the material capable of forming shallow levels in the amorphous Se, (2) a second layer comprising first and second sub-layers, each of the first and second sub-layers of the second layer consisting essentially of As, Se, Te, and the material capable of forming shallow levels in the amorphous Se, the first and second sub-layers containing more than 35%, and up to 60%, by weight of Te, (3) a third layer made from Se and As, having a decreasing As concentration in the thickness direction of the third layer, and (4) a fourth layer formed by depositing Se and $As_2Se_3$.

15. A target of an image pickup tube according to claim 1, further comprising at least one auxiliary layer for rectifying contact, provided between the transparent conductive film and the p-type photoconductive film, and wherein the p-type photoconductive film comprises (1) a first layer formed by depositing Se and $As_2Se_3$, (2) a second layer consisting essentially of As, Se, Te, and the material capable of forming shallow levels in the amorphous Se, the second layer containing more than 35%, and up to 60%, by weight of Te, (3) a third layer made from Se and As, wherein the As concentration in the third layer decreases in the thickness direction, and (4) a fourth layer made from Se and As.

16. A target of an image pickup tube according to claim 1, wherein the p-type photoconductive film includes (1) a first layer including As, Se and the material capable of forming shallow levels in the amorphous Se, (2) a second layer comprised of first and second sub-layers, the first sub-layer including As, Se, Te, and the material capable of forming shallow levels in the amorphous Se, the first sub-layer containing more than 35%, and up to 60%, by weight of Te and the second sub-layer consisting essentially of As, Se and more than 35%, and up to 60%, by weight of Te, (3) an auxiliary sensitizing layer made from Se and As, with the As concentration therein decreasing in the film thickness direction, and (4) a fourth layer formed by depositing Se and $As_2Se_3$.

17. A target of an image pickup tube according to claim 9, wherein the first layer consists essentially of As, Se and the material capable of forming shallow levels in the amorphous Se.

18. A target of an image pickup tube according to claim 11, wherein said first sub-layer of the second layer consists essentially of As, Se, Te and the material capable of forming shallow levels in the amorphous Se.

19. A target of an image pickup tube according to claim 12, wherein the first layer consists essentially of As, Se and the material capable of forming shallow levels in the amorphous Se.

20. A target of an image pickup tube according to claim 13, wherein each sub-layer of the first layer consists essentially of As, Se and the material capable of forming shallow levels in the amorphous Se, and wherein the first sub-layer of the second layer consists essentially of As, Se, Te and the material capable of forming shallow levels in the amorphous Se.

21. A target of an image pickup tube according to claim 14, wherein each of the first and second sub-layers of the first layer consists essentially of As, Se and the material capable of forming shallow levels in the amorphous Se.

22. A target of an image pickup tube according to claim 16, wherein the first layer consists essentially of As, Se and the material capable of forming shallow levels in the amorphous Se, and wherein the first sub-layer of the second layer consists essentially of As, Se, Te and the material capable of forming shallow levels in the amorphous Se.

* * * * *